US007174692B1

(12) United States Patent
Vickers et al.

(10) Patent No.: US 7,174,692 B1
(45) Date of Patent: Feb. 13, 2007

(54) BLAST RESISTANT WINDOW

(75) Inventors: Richard N. Vickers, Chipley, FL (US); Michael A. Rochefort, Panama City, FL (US); Mark Anderson, Panama City, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 269 days.

(21) Appl. No.: 10/703,038

(22) Filed: Nov. 5, 2003

Related U.S. Application Data

(60) Provisional application No. 60/424,280, filed on Nov. 6, 2002.

(51) Int. Cl.
*E04C 2/34* (2006.01)
*A47F 9/02* (2006.01)

(52) U.S. Cl. ..... 52/786.13; 52/204.593; 52/204.597; 109/5; 109/78

(58) Field of Classification Search ..... 52/786.13, 52/786.11, 786.1, 796.1, 204.593, 204.597, 52/204.6; 428/34, 213, 332; 109/5, 58, 109/62, 78, 10, 12
See application file for complete search history.

(56) References Cited

U.S. PATENT DOCUMENTS 1,703,230 A * 2/1929 Gillar ..... 52/209
3,399,294 A * 8/1968 Thieben ..... 219/522
3,872,804 A * 3/1975 Yarnall ..... 109/49.5
4,312,903 A * 1/1982 Molari, Jr. ..... 428/34
4,321,777 A * 3/1982 Sauret et al. ..... 52/308
4,595,624 A * 6/1986 Greathead ..... 428/213
4,687,687 A * 8/1987 Terneu et al. ..... 428/34
4,727,789 A * 3/1988 Katsanis et al. ..... 86/50
4,739,690 A * 4/1988 Moskowitz ..... 89/36.02
5,019,443 A * 5/1991 Hall ..... 428/215
5,368,904 A * 11/1994 Stephinson ..... 428/34
5,596,151 A * 1/1997 Rossini ..... 73/861.55
5,765,325 A * 6/1998 DeBlock ..... 52/204.5
5,834,124 A * 11/1998 Pease et al. ..... 428/430
6,108,999 A * 8/2000 Smith et al. ..... 52/786.1
6,298,607 B1 * 10/2001 Mostaghel et al. ..... 52/1
6,334,382 B2 * 1/2002 Gourio ..... 89/36.02
6,463,706 B1 * 10/2002 Guhl et al. ..... 52/204.62
6,708,595 B1 * 3/2004 Chaussade et al. ..... 89/36.02
6,818,268 B2 * 11/2004 Gonzalez ..... 428/34
6,889,480 B2 * 5/2005 Guhl et al. ..... 52/786.1
7,007,585 B2 * 3/2006 Gonzalez ..... 89/36.04
2002/0160198 A1 * 10/2002 Oshima et al. ..... 428/412
2003/0080248 A1 * 5/2003 Morgan ..... 244/118.5
2004/0216400 A1 * 11/2004 Salzer ..... 52/204.1

* cited by examiner

*Primary Examiner*—Phi Dieu Tran A
(74) *Attorney, Agent, or Firm*—AFMCLO/JAZ; Richard A. Lambert

(57) ABSTRACT

A blast resistant window structure capable of withstanding typical car bomb blast pressures of 100 psi or more and of resisting leakage of chemical or biological agents is described, the window structure including a frame hermetically enclosing two glass panels in confronting relationship defining an air gap therebetween, each glass panel having a thin layer of polymer film on each surface thereof, and a pressure relief valve in the frame for releasing air pressure from within the gap in response to blast pressure imposed on an outer surface of one of the panels.

3 Claims, 3 Drawing Sheets

BLAST RESISTANT WINDOW

CROSS-REFERENCE TO RELATED APPLICATION

This application claims priority of the filing date of Provisional Application Ser. No. 60/424,280 filed Nov. 6, 2002, the entire contents of which are incorporated by reference herein.

RIGHTS OF THE GOVERNMENT

The invention described herein may be manufactured and used by or for the Government of the United States for all governmental purposes without the payment of any royalty.

BACKGROUND OF THE INVENTION

The present invention relates generally to window structures for buildings, vehicles or other applications, and more particularly to a blast resistant window capable of withstanding blast pressures from accidental explosions, or bomb blasts from a car bomb or terrorist attack.

A terrorist attack with explosives, chemical, and/or biological weapons is a potential threat to both the civilian population and military forces. One of the weakest points on a structure is the window and transparent glass area. Many casualties may result from shattered and flying glass. Additional casualties may result from subsequent chemical and or biological weapon exposure caused by the air leaks created by the broken window. The present invention provides a novel blast resistant window structure that resists the blast pressures generated by an explosive device and prevents glass and chem-bio injuries.

The combined threat of blast with chemical or biological weapons imposes major engineering demands on a window structure to resist extremely high blast pressures, and to maintain a seal to prevent entry of chemical or biological contaminants. Previous solutions to the threat of a blast combined with either a chemical or biological weapon (combined threat) have treated the two parts of the combined threat as two separate, isolated problems. Generally, in the past, a higher priority has been given to the blast resistance portion of the combined threat. However, presently, separate solutions are insufficient to combat the combined threat.

Prior art structures for blast resistant windows field have included the application of a safety film to the interior side of the glass, using laminated glass, using double pane glass and/or using a thicker glass pane. None of these structures have demonstrated a capability for resisting blast loads on the order of 100 psi reflected pressure. Currently available, commercial off-the-shelf, blast-resistant windows typically fail at blast pressures well below 10 psi, and usually can withstand blast pressures of only about 4 psi. The ability to withstand extremely high blast pressures, yet remain leakproof, is a unique attribute of the invention described herein.

Information related to the principles underlying the invention may be found in Dover et al, "Sealed Window Glazing System for Chemical Biological Protected Space Applications," Proceedings, NBC Defense Collective Protection Conference (COLPRO 02), Orlando Fla. (2002), contained in the cross-referenced related application, and in "Sealed, Blast-Resistant Windows for Retrofit Protection Against the Terrorist Threat," Proceedings, 2$^{nd}$ International Conference on Innovation in Architecture, Engineering and Construction (AEC), Loughborough University UK (2003), the entire teachings of which are incorporated herein by reference.

It is a principal object of the invention to provide a blast resistant window structure.

It is another object of the invention to provide a window structure resistant to blast pressures up to about 100 psi.

It is another object of the invention to provide a blast resistant window having a protection against leaking of biological or chemical substances through the window structure.

It is another object of the invention to provide a window structure resistant to glass shard impact.

It is yet another object of the invention to provide a blast resistant window structure resistant to Catastrophic failure that would result in glass shard injuries.

SUMMARY OF THE INVENTION

In accordance with the foregoing principles and objects of the invention a blast resistant window structure capable of withstanding typical car bomb blast pressures of 100 psi or more and of resisting leakage of chemical or biological agents is described, the window structure including a frame hermetically enclosing two glass panels in confronting relationship defining an air gap therebetween, each glass panel having a thin layer of polymer film on each surface thereof, and a pressure relief valve in the frame for releasing air pressure from within the gap in response to blast pressure imposed on an outer surface of one of the panels.

BRIEF DESCRIPTION OF THE DRAWINGS

The accompanying drawings are incorporated into, and form a part of, the specification. The drawings illustrate several aspects of the present invention and together with the description, explain, and disclose the invention. To facilitate an understanding of the invention, like elements have been assigned like identifiers, and for clarity of presentation of the drawings, certain identifiers of elements appearing more than once in the drawings have been presented only once in the drawings.

DETAILED DESCRIPTION OF THE INVENTION

Figure 1:
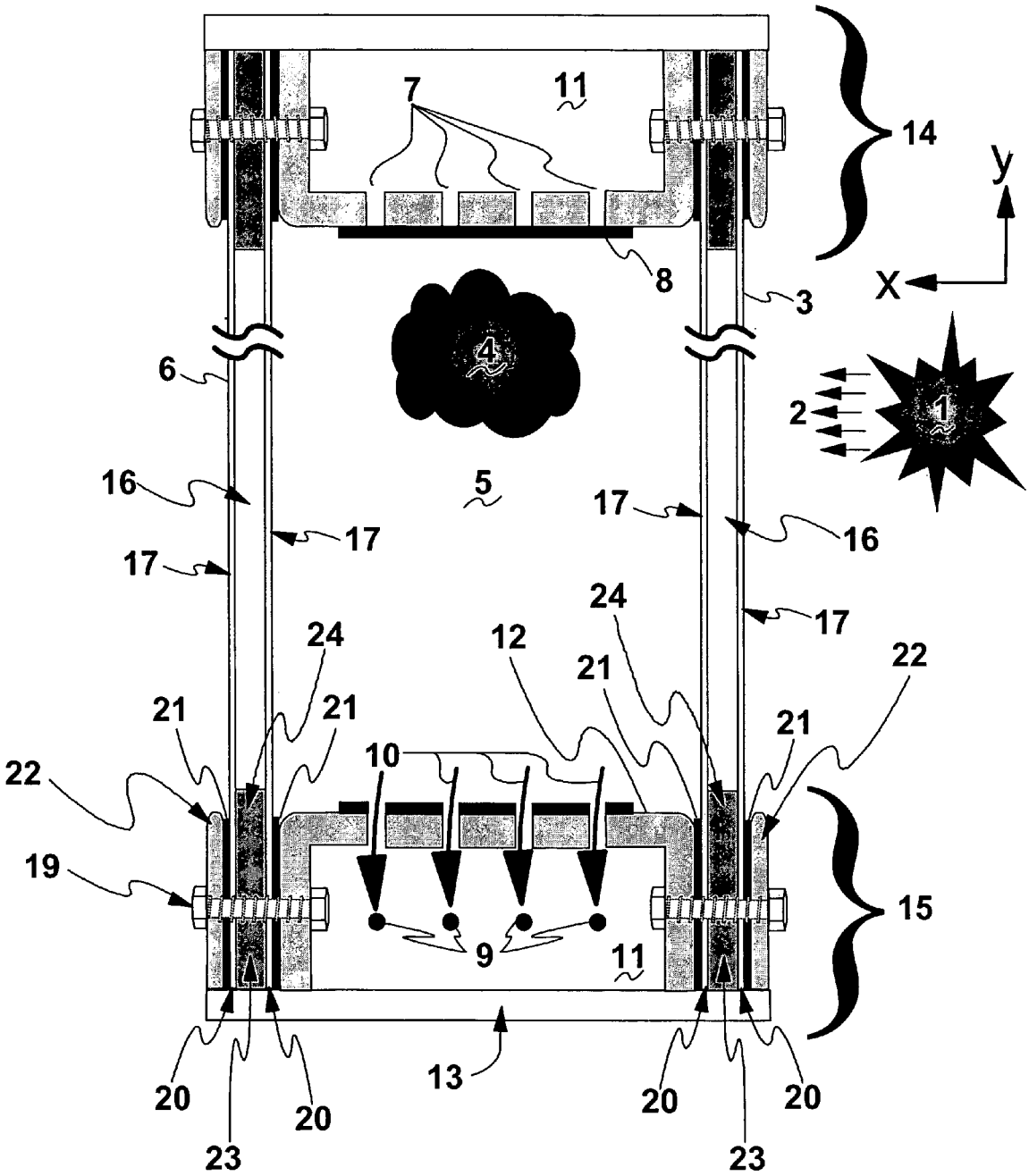
FIG. 1 shows a vertical side sectional view of a representative embodiment of the window structure of the invention.

In order to promote a full understanding of the invention, the following terms as used herein shall have the following definitions, not inconsistent with their plain, commonly accepted definitions.

"Amplitude" or "magnitude" refers synonymously to the peak amount of deflection of a structural component caused by an external loading.

"Aspect ratio" refers to the proportioning of height to width.

"Back panel" refers to the window panel that faces the inside of the structure in which the window is installed.

"Blast pressure" or "reflected pressure" or "incident pressure" are used synonymously to refer to the magnitude of pressure that could be measured at the front face of the window due to a nearly-planar pressure wave induced by an exterior explosive device.

"Core" or "panel core" refers synonymously to that portion of the panel contained between two sheets of polymer film whose tails are used to anchor the panel.

"Damping" refers to a physical mechanism that reduces vibration amplitude at a rate proportional to the velocity of the vibrating object; however, in common usage (and as used herein), the term "damping" is generically used to describe any mechanism which reduces the amplitude of a vibration to a level lower than that which would otherwise be expected.

"Damping chamber" refers to the "air gap" between the front and back panels contained within the metal frame that acts as an air spring to slow the inward movement of the front panel when hit with a blast wave, but also has built-in pressure relief to provide additional protection for the back panel as the air pressure rises within the damping chamber.

"Film" refers to transparent polymer sheeting, also referred to as "safety film".

"Film tail" is the edge of the polymer sheeting that extends beyond the outer edge of each panel.

"Film tail anchoring" refers to the mounting of the panels within the window frame by attaching the film tails to the window frame using friction or an adhesive.

"Flexible" refers to the ability of a material to deform in at least one direction under a load without suffering a brittle structural failure.

"Front panel" refers to the panel in the window structure of the invention facing external of the structure in which the window is installed.

"Internal pressure" refers to the buildup in pressure in the gap between the two sealed panels as the front panel deflects inwardly under externally applied incident pressure.

"Leaking" refers to the inability of a barrier to prevent the movement of contaminants from one side of the barrier to the other, such as the movement of chemical or biological agents from the outer window panel, through the inner window panel. Leaking is typically measured by either "wet" tests (a liquid stimulant, usually water, sometimes with an identifying chemical additive, representing a water-borne contaminant put into contact with the barrier, the degree of movement through the barrier then observed) or "smoke" tests (a gaseous simulant, usually some type of smoke, representing an airborne contaminant put in contact with the barrier and the degree of movement through the barrier then observed).

"Leak proof" refers to a barrier for preventing movement of contaminants from one side of the barrier to the other; herein specifically preventing movement of contaminants from outside the front panel where the blast pressure is applied, through the back panel and into the structure in which the window is installed.

"Oscillation" refers to a cyclic motion; in the structure of the invention, each panel acts as a membrane, and moves back and forth (oscillates) in response to the blast loading.

"Pane" is a single layer of glass.

"Panel" means a laminate structure of one or more layers of transparent glass protected on the front and back with transparent polymer film.

"Transparent" refers to the human ability to see through a substance. A substance is transparent if a person with 20/20 vision as typically measured by American standards can see at least 20/250 or better through the substance placed for optimum transparent viewing.

"Window" refers to a structural component whose distinguishing feature is transparency.

Referring now to the drawings, FIG. 1 shows a vertical side sectional view of a first embodiment of a double pane window structure of the invention, referred to herein as the "Flex" window. As suggested in FIG. 1, an explosion 1 causes a near-planar blast wave 2 to impact the front window panel 3. The front window panel 3 deflects inwardly (i.e., in the x direction), in turn causing a build-up in pressure 4 inside the damping chamber 5. The buildup in pressure 4 within damping chamber 5 will then tend to deform the back panel 6 (also in the x direction). The damping chamber 5 has one or more vent holes 7 that vary in number, size, and spacing in relation to the surface area, aspect ratio, and distance between the front and back panels (that is, they vary in relation to the geometry of the panels and the volume of air within the damping chamber 5). Vent holes 7 are sealed by tape 8 of substantially any type as would occur to the skilled artisan practicing the invention and of varying thickness/strength 8 that rupture or pop open as at 9 under high pressure 4 and vent air 10 into the wall cavity 11 between the window frame 12 and the surrounding wall 13, to relieve pressure 4 inside damping chamber 5 and thereby lessen the pressure applied to back panel 6. Window frame 12 completely surrounds panels 3 and 6 so that the upper cross-sectional view of the frame assembly 14 is actually a mirror image of the lower cross-sectional view of the frame assembly 15; except that the upper cross-sectional view of the frame assembly 14 is used to illustrate the vent holes 7 in their sealed condition 8, whereas the lower cross-sectional view of the frame assembly 15 is used to illustrate the vent holes after the tape has popped through vent holes 7 as shown at 9. The venting 10 may, or may not, cause the circlets of tape 9 to completely disengage from the tape strip 8, but are shown as disengaged 9 for a more clear illustration of the venting process. The window shown in FIG. 1 has two panels, each having a single pane of glass 16 (typically, tempered or annealed) with transparent polymer film 17 layers applied to both sides thereof. Film 17 may comprise substantially any commercially available polymer for enforcing panels 3 and 6, the same not considered limiting of the invention described and claimed herein. Each film 17 has a marginal (tail) portion 20 that extends beyond the outer edges of each glass pane and contacts a mounting frame 23, comprising butyl rubber or other suitable elastomeric material, that surrounds the edges of the glass panes. Film tails 20 are anchored to the frame assembly either by pressure (friction) or by suitable commercially available adhesive 21. The friction results from compressive forces caused by a bolt 19 that draws the outer metal frame 22 toward an inner metal frame 12, causing film tails 20 to compress against frame 23. Mounting frame 23 helps anchor film tails 20 and also extends 24 beyond the metal frame 12, so that it prevents the outer edges of the glass pane 16 from shearing against the metal frame 12. Therefore, it is the membrane action of films 17, and the film anchoring, that gives the Flex window its outstanding properties. In fact, for design purposes, the enclosed glass pane 16 is treated as having no strength; and, therefore, for blast design is assumed to act strictly as a geometric spacer between films 17. However, prior to being subjected to a blast load 2, panes 16 do fulfill a significant structural purpose as adding rigidity to panels 3 and 6.

Figure 2:
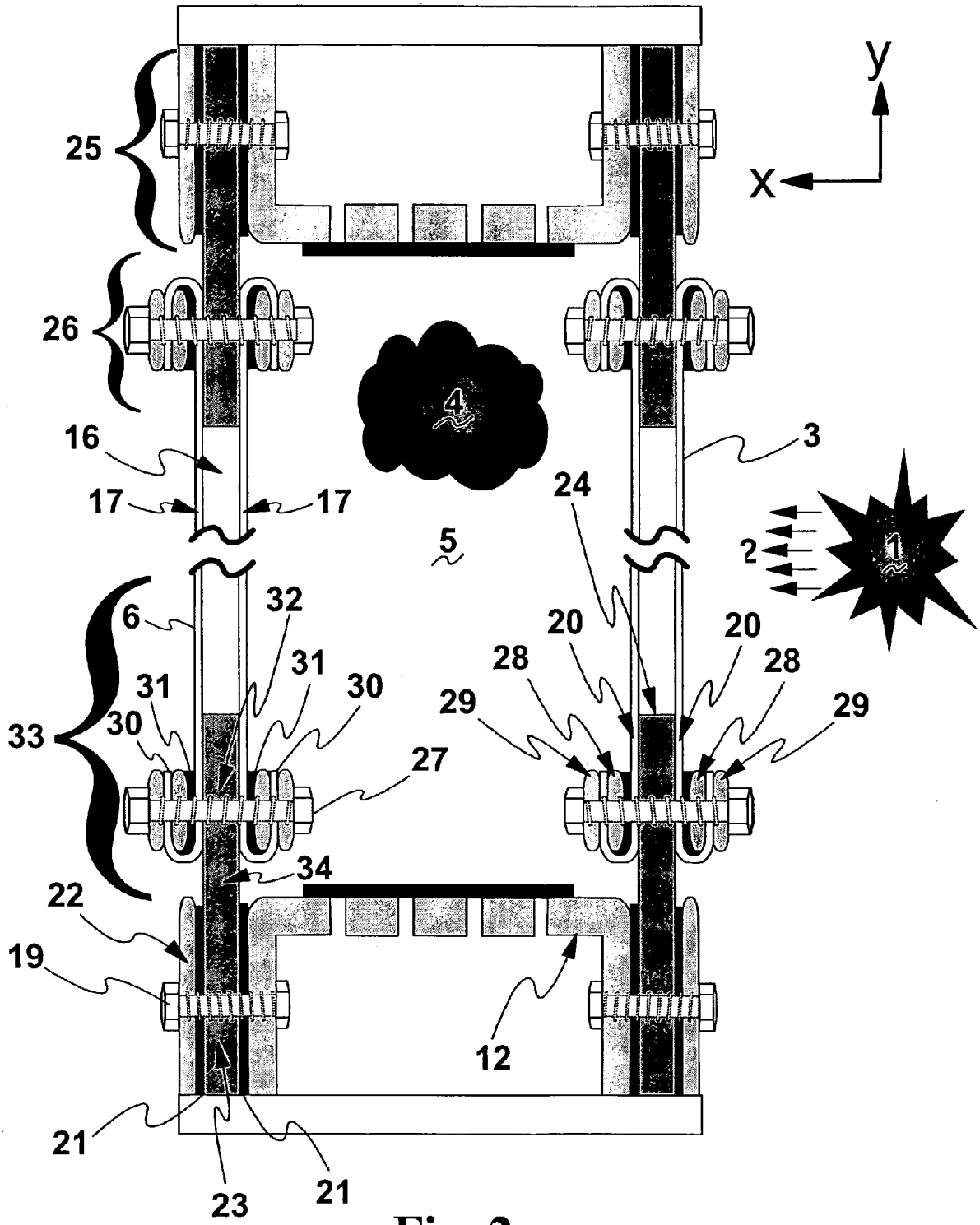
FIG. 2 shows a vertical side sectional view of an alternative embodiment of the invention that includes an alternate film tail anchoring system.

FIG. 2 shows a vertical side sectional view of a second embodiment of a double pane window structure of the invention, including an alternate film-anchoring system and referred to herein as the Super-Flex window. In manner similar to the function of the FIG. 1 structure, an explosion 1 sends a near-planar blast wave 2 toward front panel 3, which flexes inwardly in the x direction, causing pressure 4 to build up in the damping chamber 5. Panels 3 and 6 comprise glass panes 16 covered on both sides with polymer films 17 having marginal film tails 20. Each glass pane abuts against butyl rubber mounting frame 23. The window structure of FIG. 2 has a two part anchoring system including both a metal frame assembly 25 and a film tail anchoring assembly 26. Examining first the metal frame assembly 25, it is different from the FIG. 1 structure only in that there are no film tails 20 within the frame 12,22. As before, the bolt 19 compresses the outer frame 22 toward the inner frame 12, anchoring mounting frame 23 by both friction and adhesive 21. In the film tail anchoring system 26 of FIG. 2, a dual frame configuration is used to provide additional friction to grip the film tails. In this system, the bolt 27 compresses the metal frames 28,29 (dual frames on both sides of the butyl rubber mounting frame) to anchor the film tails 20 using friction and adhesive 31. To generate additional friction, the film tail 20 is threaded between the inner metal frame 28 and the butyl rubber mounting frame 32, then bent into a U-shape and threaded 30 between the inner 28 and outer 29 metal frames. The important difference between the FIG. 1 and FIG. 2 structures is the butyl rubber connection 34 between the metal frame assembly 25 and the inner portion of the panel 33 (which includes the film tail anchoring assembly 26). Under blast loads 2, the butyl rubber 34 acts almost purely as an elastic membrane. Therefore, the available elastic deformation of the butyl rubber connector 34 is essentially an enhancement to the available plastic deformation of the inner portion 33 of the Super-Flex window, resulting in a much higher degree of blast resistance. The FIG. 2 structure is more complex and expensive to fabricate but is most useful in special situations such as extremely high blast pressures or for very large surface area windows.

Figure 3:
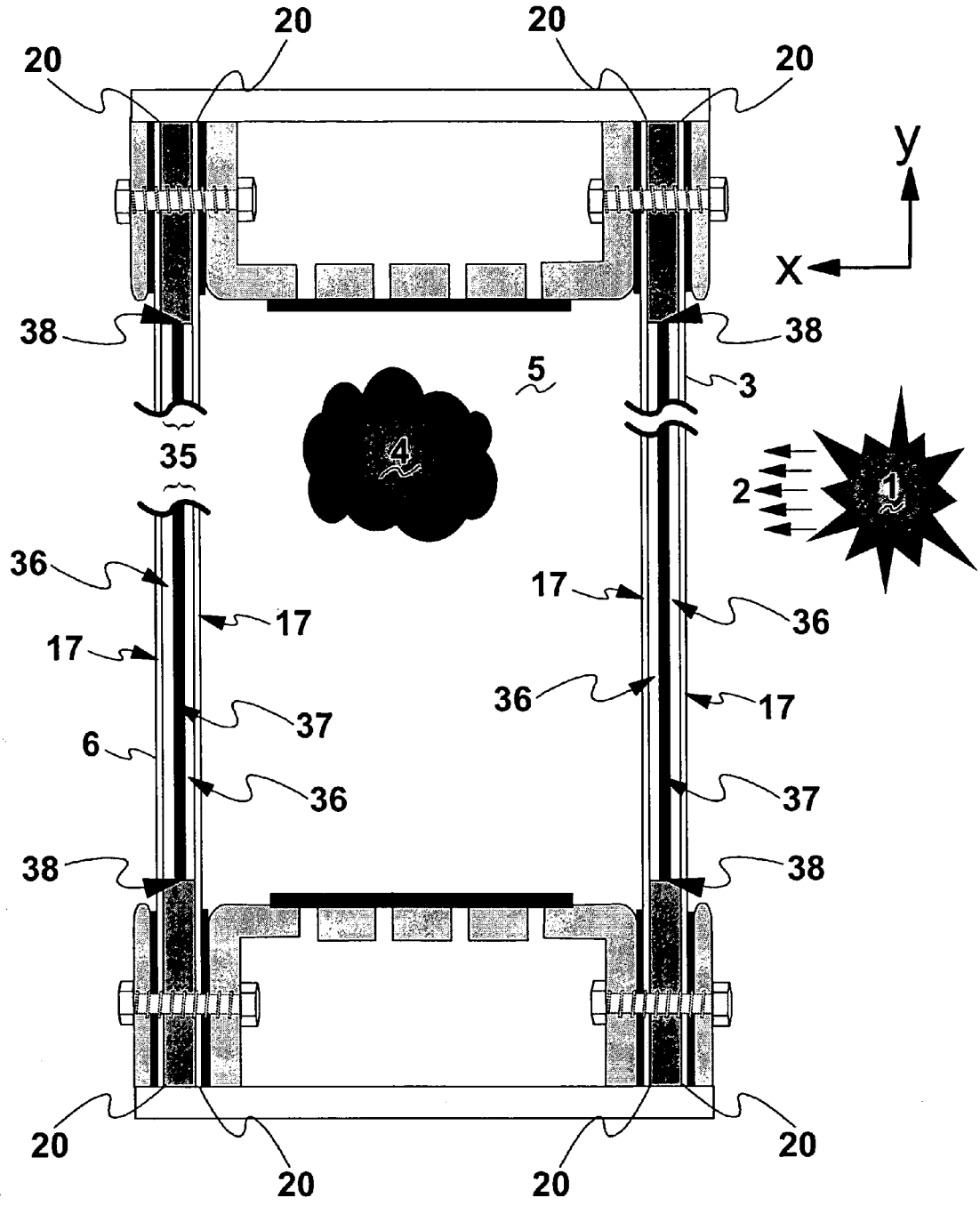
FIG. 3 shows a vertical side sectional view of an embodiment of the invention including laminated transparent panels.

FIG. 3 shows a vertical side sectional view of another embodiment of the invention including laminated transparent panels 35 useful also in either the FIG. 1 or FIG. 2 structures. The laminated glass pane 35 is disposed between two sheets of film 17 having marginal film tails 20. The inner core of the panel 35 is a laminated structure that includes two thin panes of glass 36 (usually annealed or tempered), with a heat-welded polymer sheet 37 therebetween. Panel 35 generally does not in include a film tail as at 38. An advantage of using the laminated glass pane 35 as the panel core is the extra resistance to a second blast. A single glass pane used as the panel core has a tendency to marbleize (break into small pieces) when it flexes inwardly (particularly when tempered panes are used), and the pieces drop to the inside bottom of the frame after the blast loading 2 subsides. However, the laminated glass pane 35 retains its basic geometry after the first blast (although the panel may become opaque), greatly increasing its resistance to a secondary blast.

Frame assembly 14 is configured to hold transparent panels 3,6 in place and to attach the window to the structure 13 in which the window is installed. The frame may be made of any material known to the art that has sufficient strength to make the overall window an integral component of the surrounding structure, but typically would be made of steel or other high-grade metal or a metal alloy. The structure into which the window may be incorporated may include a building, automobile, tank, aircraft, boat, or any other closed space which needs external visibility, blast resistance, and sealing for protection against chemical or biological agents. Frame assembly 14 may attach to the structure 13 by any means known in the art such that the frame and the enclosed panels become an integral component of the structure.

Panels 3,6 are transparent prior to blast loading. The core 16 of each panel consists of a pane of glass (e.g., tempered glass, annealed glass, etc.), or any uniform transparent window material known in the art (e.g., Plexiglas), or any laminated transparent window material 35 known in the art, such as laminated tempered or annealed glass. Each laminate panel typically has two thin panes 36 of glass with a film 37 heat-welded between them, but may consist of any combination of transparent materials known in the art. If the panel core is a laminate 35, each of the panels still has polymer film 17 on the front and back as above described.

Panels 3 and 6 have different purposes in the window structure of the invention other than the dual purpose of forming damping chamber 5. Front panel 3 resists the actual blast pressure wave 2, which is slowed by the compressive effect within gap 5 between the panels as panel 3 deflects inwardly. Panel 3 is also a primary seal against chemical or biological intrusion. Back panel 6 does not resist the actual blast pressure wave 2, but instead resists the internal pressure 4 that builds up within gap 5. Back panel 6 acts as a secondary seal against chemical or biological intrusion and as a physical barrier to catch any debris that passes from or through front panel 3. Therefore, so long as panel 6 remains intact, the interior of the structure 13 is protected.

Film 17 that is applied to the front and back of each panel may comprise any thin, resilient, transparent polymer or other transparent material known in the art that has adequate strength and flexibility to function as a membrane under blast loading, and may include single ply or multiple plies of the same or dissimilar materials, which in turn may have the plies aligned or at a bias to each other. The thickness of film 17 may vary depending on the anticipated blast pressure 2, but typically is at least 15 mils. Each film 17 is applied to the panel core 16,35 as an oversized sheet, with extended edges 20 (tails) held by an anchoring system 19–24,26. The anchoring system provides a gripping force sufficient to hold the panel against the blast pressure. The film tail length may vary, but is typically at least 1½ inches, and generally must be of sufficient length to fully engage the anchoring system 19–24,26.

The anchoring system 19–24,26 structural integrity is important to the proper functioning of gap 5 acting as a damping chamber, allowing the window structure to withstand extreme blast pressures 2 without leaking. Prior to impact by a blast pressure 2, air within gap 5 is typically at ambient pressure, but a positive pressure configuration could be utilized to combat a specific chemical or biological threat. In theory, a partial vacuum could also be used in gap 5, but such a configuration would not function as a damping chamber in accordance with the preferred configurations. The gaseous material contained in the air gap 5 is typically air, but to combat specific chemical or biological threats could be nitrogen, argon, or any other inert gas, or a combination thereof, so long as the transparency of the window is maintained. Condensation within the damping chamber 5 can reduce the transparency of the window system, and should be avoided, as by use of a desiccant within the window structure.

When a blast pressure 2 impacts front panel 3 and deflects it inwardly, the pressure build-up within gap 5 affords certain advantages to the window structure, including reduction of the risk of catastrophic failure. First, the pressure buildup acts as an air spring in that the increased pressure within gap 5 resists the inward movement of front panel 3. Second, there is a time lag between the peak deflection of the front panel 3 and the peak deflection of the back panel 6, due to the minute but distinct time it takes to build up pressure within gap S. Therefore, a time lag exists between the cyclic oscillation of front panel 3 and the cyclic oscillation of the back panel 6 that tends to reduce the peak deflection of the back panel 6, that is, front panel 3 begins to rebound before back panel 6 reaches peak deflection, resulting in a corresponding reduction in internal pressure in gap 5 that in turn reduces the peak deflection of back panel 6. Additionally, vent holes 7 will reduce the internal pressure before reaching a level that threatens the integrity of back panel 6. A strip 8 of material that seals holes 7 is typically a commercial off-the-shelf metallic tape, but may also comprise any material known to the art that has the proper combination of thickness, shear strength and adhesion, as to rupture or pop open under the effect of pressure within gap 5 to release into the wall cavity 11 internal pressure within gap 5 that would otherwise endanger the integrity of the back panel 6.

Windows structured according to the teachings hereof may be substantially blast-resistant and leak proof up to blast pressures of 100 psi or higher. The blast pressure 2 is measured by a high-speed pressure transducer mounted at or about the front surface of the front panel 3. Currently available, commercial off-the-shelf, "blast-resistant" windows typically fail at blast pressures well below 10 psi (most often, they can withstand blast pressures of about 4 psi). The ability to withstand extremely high blast pressures 2, yet remain leak-proof, is unique to the Flex and Super-Flex windows.

The invention therefore provides a blast resistant window structure for withstanding blast pressures from accidental explosions, or bomb blasts from a car bomb or terrorist attack. It is understood that modifications to the invention may be made as might occur to one skilled in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

We claim:

1. A blast-resistant, leak proof, window structure, comprising:

a first outwardly facing transparent panel, said first panel including a first central transparent layer having a first outer surface and a second inner surface and first and second polymer layers in laminar contact on said respective first outer and second inner surfaces of said first central transparent layer, said first and second polymer layers each being larger in area than said first central transparent layer defining marginal portions of said first and second polymer layers around the periphery of said first central transparent layer;

a second inwardly facing transparent panel disposed in spaced parallel relationship with said first transparent panel, said second panel including a second central transparent layer having a first outer surface and a second inner surface and third and fourth polymer layers in laminar contact on said respective first outer and second inner surfaces of said second central transparent layer, said third and fourth polymer layers each being larger in area than said second central transparent layer defining marginal portions of said first and second polymer layers around the periphery of said second central transparent layer;

a frame assembly supporting said first and second panels in said spaced parallel relationship defining an air gap between said first and second panels;

means for substantially hermetically sealing said first and second panels within said frame at said margins of said first, second, third and fourth polymer layers;

pressure relief means on said frame for relieving pressure within said air gap generated in response to blast pressure imposed on an outer surface of the window structure, said pressure relief means being at least one sealed vent hole in said frame, each said vent hole being sealed by a strip of material that is rupturable under the effect of pressure within said air gap.

2. The window structure of claim 1 wherein each of the central transparent layers of said first and second panels comprise one or more layers of glass.

3. The window of structure of claim 1 wherein said means for sealing said panels within said frame includes an elastomer seal.

* * * * *